US008033874B2

(12) United States Patent
Chen

(10) Patent No.: US 8,033,874 B2
(45) Date of Patent: Oct. 11, 2011

(54) CABLE CONNECTOR WITH IMPROVED CONTACTS ENSURING RELIABLE CONNECTION WITH CABLES

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/828,311

(22) Filed: Jul. 1, 2010

(65) Prior Publication Data

US 2011/0092105 A1 Apr. 21, 2011

(30) Foreign Application Priority Data

Oct. 20, 2009 (CN) ..... 2009 2 0312796

(51) Int. Cl.
*H01R 13/432* (2006.01)

(52) U.S. Cl. ..... 439/746

(58) Field of Classification Search ..... 439/660, 439/746–749, 752.5, 871–872, 851–857, 439/861, 595, 382, 891
See application file for complete search history.

(56) References Cited

U.S. PATENT DOCUMENTS

| | | | | |
|---|---|---|---|---|
| 4,626,061 | A * | 12/1986 | Patton | 439/746 |
| 5,362,260 | A * | 11/1994 | Peloza | 439/746 |
| 5,921,822 | A * | 7/1999 | Kennedy et al. | 439/851 |
| 6,905,373 | B2 | 6/2005 | Wu | |
| 2010/0029146 | A1 * | 2/2010 | Myer et al. | 439/852 |
| 2010/0041283 | A1 * | 2/2010 | Hernandez et al. | 439/851 |

* cited by examiner

*Primary Examiner* — Edwin A. Leon
(74) *Attorney, Agent, or Firm* — Wei Te Chung; Andrew C. Cheng; Ming Chieh Chang

(57) ABSTRACT

A cable connector includes an insulating housing having a plurality of cavities, a plurality of contacts received in corresponding cavities of the housing, and a plurality of cables terminated to the corresponding contacts. Each contact defines an intermediate portion, a pair of side contact beams extending from two opposite sides of the intermediate portion and a tail portion extending from an opposite end of the intermediate portion. The tail portion defines a second pair of gripping wings, each gripping wing defines a first locking portion and a second locking portion connecting with the first locking portion, the first locking portion and the second locking portion have a different height.

8 Claims, 4 Drawing Sheets

CABLE CONNECTOR WITH IMPROVED CONTACTS ENSURING RELIABLE CONNECTION WITH CABLES

BACKGROUND OF THE INVENTION

1. Field of the Invention

The present invention relates to a cable connector, and particularly to a cable connector having improved contacts for ensuring a reliable connection with corresponding cables.

2. Description of Related Arts

Electrical connectors are widely used in electronic systems for establishing an electrical connection between two electronic devices thereof. Some electronic devices, such as servers, are equipped with power connectors for carrying power. These power connectors generally comprise two mating halves, i.e., a plug connector connecting with a circuit substrate and a receptacle cable connector connecting with a power supply system for supplying power to the circuit substrate. The receptacle cable connector generally comprises a unitarily molded insulating housing, a plurality of socket-type power contacts retained in the housing, and a plurality of cables terminated to corresponding power contacts. U.S. Pat. No. 6,905,373 issued to Jerry discloses a cable connector. The cable connector comprises a housing, a plurality of contacts received in the housing and a number of cables corresponding to the contacts respectively. The contact defines a pair of first gripping wings for engaging with outer insulator of the cable and a pair of second gripping wings for engaging with conductive core of the cable. The gripping wings are adapted to wrap around the corresponding cable by means of a crimp tool for ensuring a reliable connection between the contact and the cable. However, with the assembling factor, the gripping wings may be breaking the conductive core of the cable.

Hence, an improved electrical contact for a cable connector is required to overcome the disadvantages of the related art.

SUMMARY OF THE INVENTION

An object of the present invention is to provide a cable connector having improved contacts for ensuring a reliable connection with corresponding cables.

To arrive said object, a cable connector includes an insulating housing having a plurality of cavities, a plurality of contacts received in corresponding cavities of the housing, and a plurality of cables terminated to the corresponding contacts. Each contact defines an intermediate portion, a pair of side contact beams extending from two opposite sides of the intermediate portion and a tail portion extending from an opposite end of the intermediate portion. The tail portion defines a second pair of gripping wings, each gripping wing defines a first locking portion and a second locking portion connecting with the first locking portion, the first locking portion and the second locking portion have a different height.

Other advantages and novel features of the invention will become more apparent from the following detailed description of the present embodiment when taken in conjunction with the accompanying drawings

DETAILED DESCRIPTION OF THE PREFERRED EMBODIMENT

Figure 1:
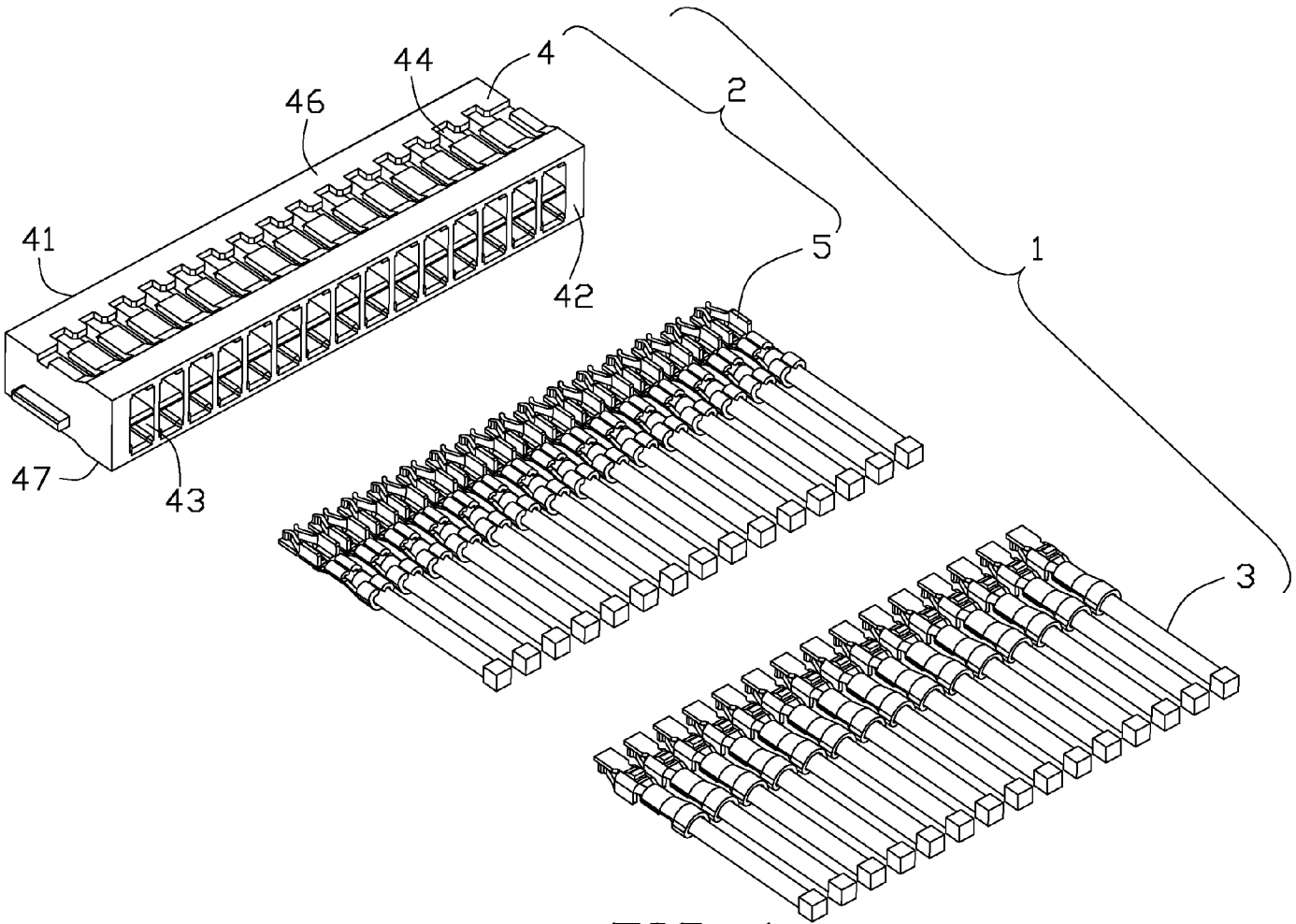
FIG. 1 is an exploded perspective view of a cable connector in accordance with the present invention.
Figure 2:
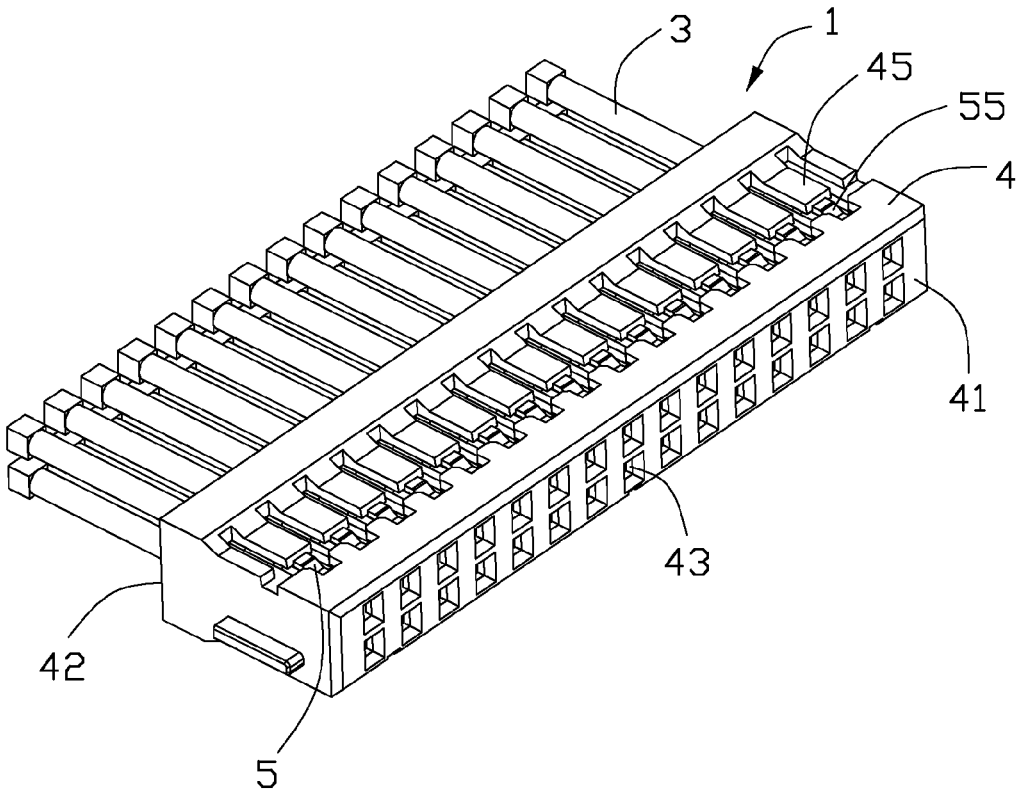
FIG. 2 is an assembled perspective view of the cable connector.

Further detailed description of the preferred embodiments of this present invention is set forth below along with the attached drawings.

Referring to FIGS. 1-4, a cable connector 1 in accordance with the present invention comprises a receptacle connector 2 and a plurality of cables 3 electrically connecting with the receptacle connector 2. Each cable 3 includes an inner conductive core 30 and an outer insulator 31 surrounding the inner conductive core 30. The conductive core 30 exposes outside at one end of the cable 3.

The receptacle connector 2 includes a rectangular insulating housing 4 and a plurality of contacts 5 received in the housing 4. The housing 4 has a front face 41 and a rear face 42 opposite to the front face 41. The housing 4 defines a plurality of cavities 43 extending through the front face 41 and the rear face 42 along a lateral direction thereof and a corresponding number of slots 44 extending through a top face 46 or a bottom face 47 of the insulating housing 4 and communicating with the corresponding cavities 43. A plurality of latching portions 45 is formed on the top face 46 or bottom face 47 of the housing 4.

Figure 3:
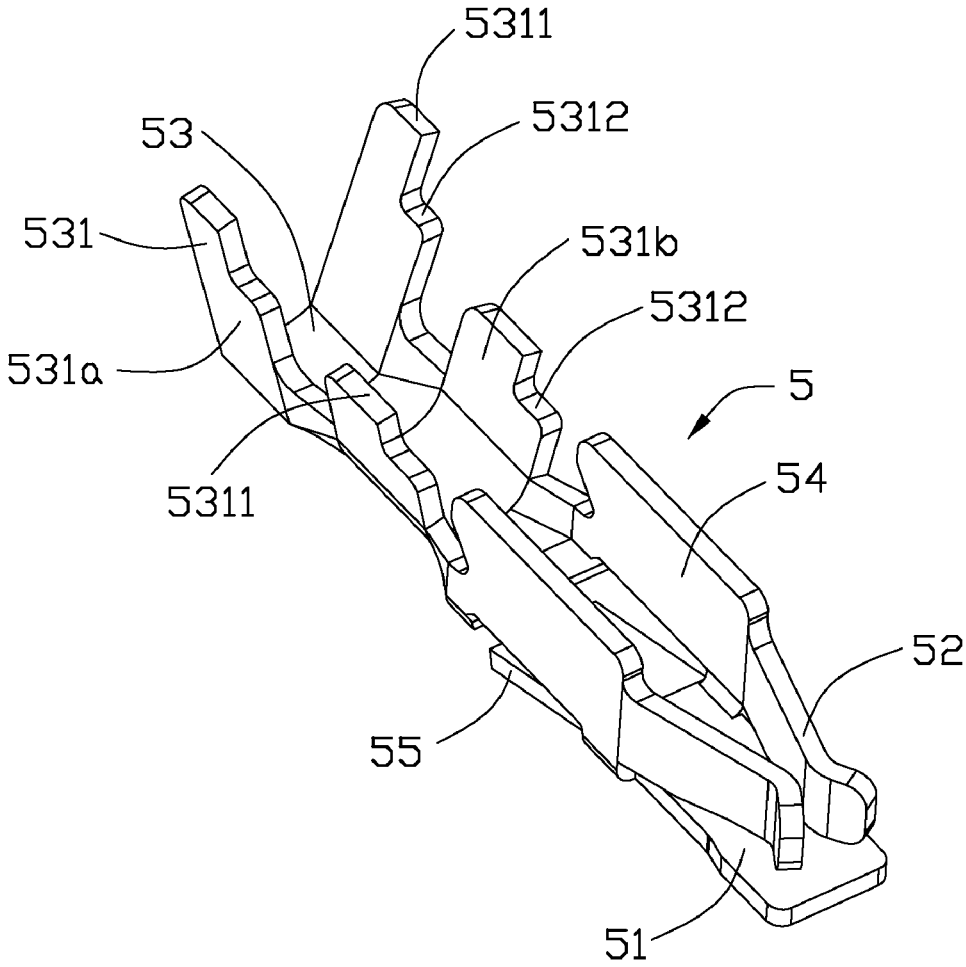
FIG. 3 is an perspective view of the contact of the cable connector.

Every one of the contacts 5 is identical in structure and an exemplary one thereof is shown in FIG. 3. Each contact 5 is formed from a conductive material and includes a planar intermediate portion 51, a pair of connecting portions 54 defined at the opposite side of the intermediate portion 51, a pair of side contact beams 52 respectively extending forwardly from free ends of the connecting portions 54, and a tail portion 53 extending rearwardly from a rear end of the intermediate portion 51 to electrically contact with a corresponding cable 3. In addition, the intermediate portion defines a tab 55 extending downwardly and rearwardly to the corresponding latching portion 45 of the insulating housing 4.

The tail portion 53 defines a pair of first gripping wings 531*a* crimping to the outer insulator 31 of the corresponding cable 3 for ensuring a reliable connection between the contact 5 and the corresponding cable 3, and a pair of second gripping wings 531*b* crimping to the conductive core 30 of the corresponding cable 3 for ensuring an electrical connection between the contact 5 and the corresponding cable 3. The first gripping wings 531*a* are defined behind the second gripping wings 531*b*, and the first gripping wings 531*a* are higher than the second gripping 531*b*. Each contact 5 is crimped to a corresponding cable 3 with gripping wings 531 surroundingly engaging outside surfaces of the exposed conductive core 30 and the outer insulator 31 by means of a crimp tool (not shown). In the preferred embodiment of the present invention, each gripping wing 531 comprises a first locking portion 5311 and a second locking portion 5312 connecting with the first locking portion 5311. The first locking portion 5311 and the second locking portion 5312 have different height, and they are formed with the step-shape. In addition, the first locking portion 5311 has a top edge which is parallel with a top edge of the second locking portion 5312, and the top edge of the first locking portion 5311 is higher than the top edge of the second locking portion 5312.

Figure 4:
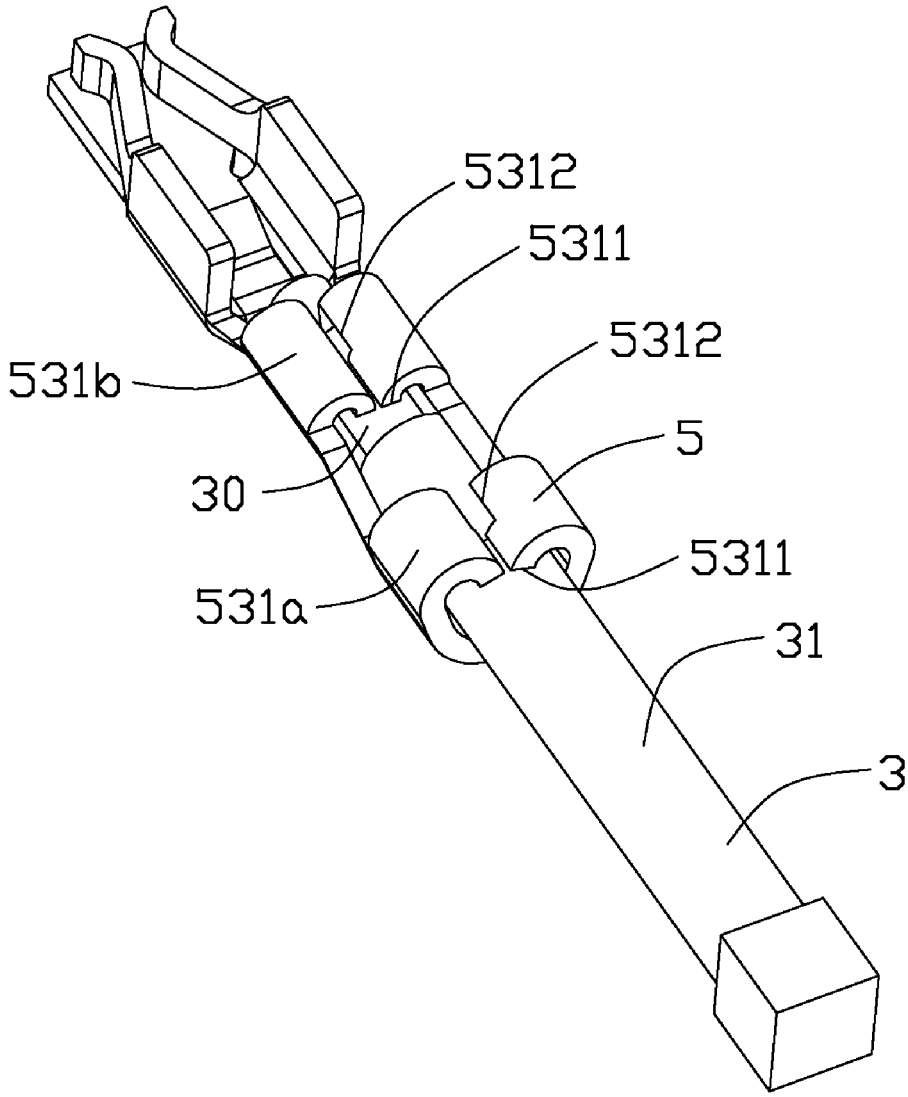
FIG. 4 is an assembled perspective view of the contact with the corresponding cable.

FIG. 4 shows the retention of the gripping wings 531 of the contact 5 to the corresponding cable 3. Firstly, the first locking portion 5311 is pressed to the corresponding cable 3, and then the second locking portion 5312 is pressed to the corresponding cable 3. The second locking portion 5312 has a cushioning effect opposite to the first locking portion 5311 so as to prevent from breaking the cable 3. According to practical condition, the locking portions 5311, 5312 can be defined at the second gripping wings 531*b* only, or defined at all the gripping wings 531.

Referring to FIGS. 1-4, when assembly, firstly, each contact 5 connecting with one corresponding cable 3 is then inserted into a corresponding cavity 43 of the housing 4 from the rear face 42. The tab 55 of the intermediate portion 51 is received in the corresponding slot 44 of the housing 4 and engaging with the corresponding latching portion 45 for preventing the contact 5 from moving rearwardly. The cable connector 1 of the present invention is thus formed.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

I claim:

1. A cable connector comprising:

an insulating housing defining a plurality of cavities;

a plurality of contacts received in corresponding cavities of the housing, each contact comprising a connection portion retained in the cavity, a pair of contact beams extending from a front edge of the connection portion and a tail portion extending from a rear edge of the connection portion; and a plurality of cables comprising an outer insulator and an inner conductive core exposing to a front end of the outer insulator;

wherein the tail portion defines a pair of front gripping wings crimping to the inner core and a pair of rear gripping wings crimping to the outer insulator of the corresponding cable, each gripping wing defines a lower locking portion and a higher locking portion.

2. The cable connector as described in claim 1, wherein each of lower locking portions and higher locking portions define a horizontal top face and the top faces of the higher locking portions pierce into the cable under condition that the top faces of each pair of gripping wings are not stagger in a axial direction of the cable.

3. The cable connector as described in claim 1, wherein the lower locking portion of the front gripping wing is lower than the lower locking portion of the rear gripping wing and the higher locking portion of the front gripping wing is lower than the higher locking portion of the rear gripping wing.

4. The cable connector as described in claim 3, wherein the lower locking portion of the front gripping wing is in front of the higher portion thereof and the lower locking portion of the rear gripping wing is in front of the higher portion thereof.

5. A cable connector comprising:

a plurality of contacts, each contact including a retaining portion, a pair of contact beams extending forwardly from free ends of the retaining portions and a tail portion extending rearwardly from a rear end of the retaining portion, a plurality of cables comprising an outer insulator and an inner conductive core exposing to a front end of the outer insulator;

the tail portion defines a pair of front gripping wings crimping to the inner core and a pair of rear gripping wings crimping to the outer insulator of the corresponding cable, wherein each pair of gripping wings has a same shape and are symmetrical to each other.

6. The cable connector as described in claim 5, wherein each gripping wing has a rear longer locking portion and a front shorter locking portion.

7. The cable connector as described in claim 6, wherein the longer locking portion pierces into the outer insulator and the shorter locking portion presses against outside of the outer insulator.

8. A cable connector comprising:

an insulating housing defining a plurality of cavities;

a plurality of contacts respectively received in corresponding cavities of the housing, each of said contacts defines a front mating portion and a rear tail portion, each of the tail portion defining a pair of front gripping wings and a pair of rear gripping wings; and a plurality of cables respectively connected to the tail portions of corresponding contacts, each of said cables defining an inner conductor and an outer insulator under condition that said inner conductor is grasped by the pair of front gripping wings and said outer insulator is grasped by the pair of rear gripping wings; wherein wherein each of the pair of front gripping wings and the pair of rear gripping wings defines a step-shaped top face so that each gripping wing has a longer circumference section and a shorter circumference section axially under condition that the longer circumference section applies larger forces upon the cable than the shorter circumference section.

* * * * *